United States Patent [19]

McKenzie

[11] 4,290,635

[45] Sep. 22, 1981

[54] DOOR LOCKING DEVICE

[75] Inventor: Kenneth B. McKenzie, Weston, Canada

[73] Assignee: Port-A-Lock Incorporated, Weston, Canada

[21] Appl. No.: 59,894

[22] Filed: Jul. 25, 1979

[51] Int. Cl.[3] ..... E05C 19/18

[52] U.S. Cl. ..... 292/290

[58] Field of Search ..... 292/290, 291, 293, 294, 292/297, 298

[56] References Cited

U.S. PATENT DOCUMENTS

| | | | |
|---|---|---|---|
| 969,631 | 9/1910 | Johnson | 292/293 |
| 1,255,996 | 2/1918 | Ehrhardt | 292/293 |
| 1,293,414 | 2/1919 | Grimeck | 292/290 |
| 2,461,398 | 2/1949 | Sands | 292/290 X |
| 3,429,151 | 2/1969 | Weingart | 292/291 X |

*Primary Examiner*—Richard E. Moore

*Attorney, Agent, or Firm*—Sim & McBurney

[57] ABSTRACT

There is provided a portable door lock having an elongated flat bar for insertion between a door and a door frame, a slide block on the flat bar, and a brace member which supports two spaced apart contact surfaces such that one surface can rest against the door and the other can rest against either the frame or the wall adjacent the frame. The brace member is pivotally mounted, and releasable means are provided to prevent the slide block from moving along the flat bar away from the door. The slide block thus maintains the brace member close to and against the door/frame surfaces.

7 Claims, 6 Drawing Figures

FIG.1
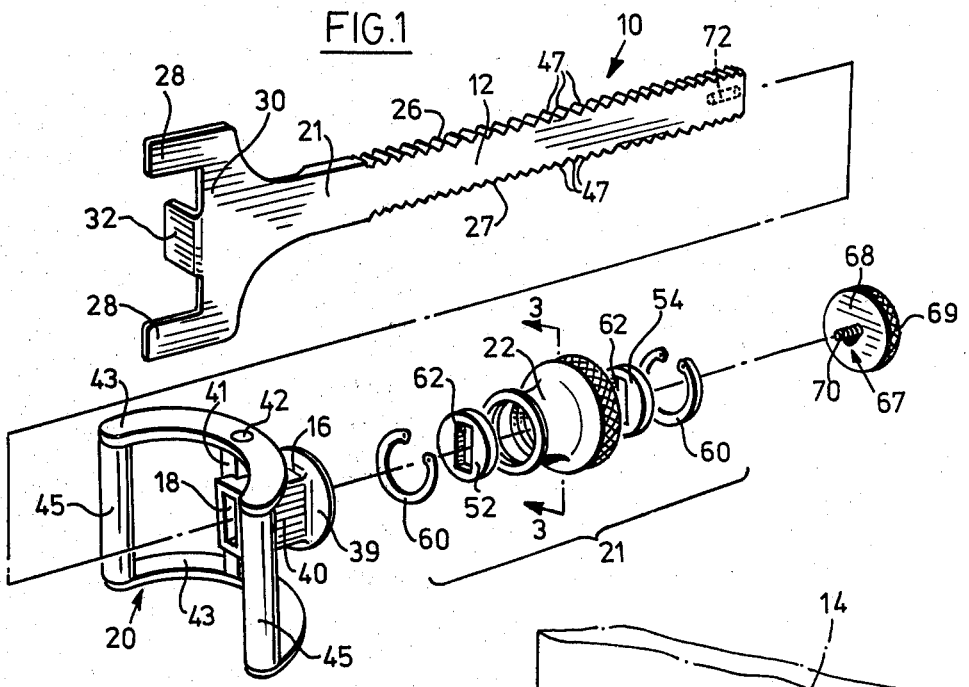
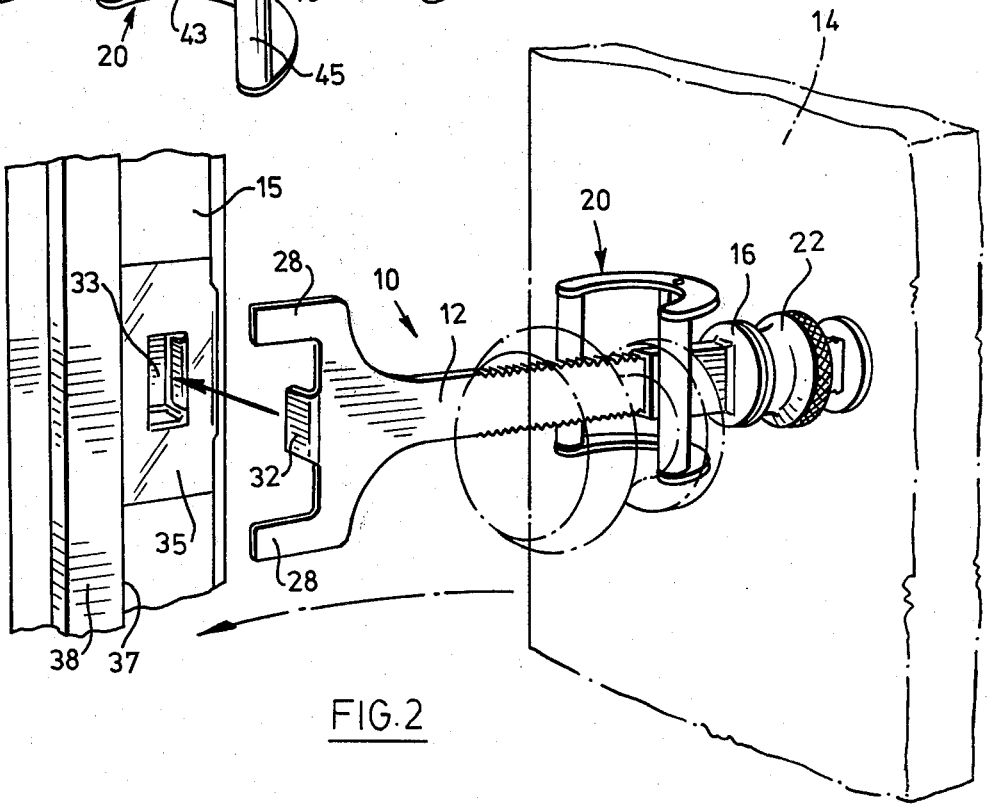
FIG.2

DOOR LOCKING DEVICE

This invention relates to a portable door lock, of the kind which can be applied to a door by the user from within a room which is to be secured.

Many door locks have been suggested using a latch bar that extends between the door and the frame with a hook to engage the frame or the edge of a hole in a strike plate secured to the frame, and having a sliding block member adapted to move up to and abut against a closed door. In these prior art devices, means are provided for keeping the sliding block member in its forward position (i.e. the position closest to the door), thereby locking the door in the closed position.

One of the disadvantages of the prior art devices is the tendency for the sliding block member to scratch or scuff the wooden surface against which it abuts. Another disadvantage arises when the door and the frame are not flush with each other. In such cases, the sliding block member will abut against one of the two, but not the other. Where the frame extends forwardly of the door, the door is then somewhat loose, and a certain amount of "play" arises before the door will come up against the sliding block member. Any attempt to open the door, even a legitimate attempt for example by a member of the cleaning staff in a hotel, will even more seriously damage or dent the wood of the door.

Finally, a disadvantage of the prior art devices relates to the means by which the sliding block member is maintained in its door-ward position, since most of such means are complex, and often utilize separate, removable wedge members and the like, which can become lost if not in some way attached to the remainder of the device.

It is an aspect of this invention to remedy the foregoing disadvantages of the prior art devices.

To this end, the present invention provides a portable door lock comprising:

an elongated flat bar for insertion between a door and a door frame, the flat bar having flat sides, narrow upper and lower edges, and hook means at one end for engaging the frame, a slide block having an internal opening for receiving said flat bar such that the slide block is slidable along the flat bar, a brace member pivotally mounted on the slide block and supporting two spaced contact surfaces projecting in the direction of the hook means, whereby one surface can rest against the door and the other against either the frame or the wall adjacent the frame, the contact surfaces being formed by resilient plastic tubes mounted on metal posts, and releasable means for preventing the slide block from moving along the flat bar in the direction away from the hook means.

One embodiment of this invention is illustrated in the accompanying drawings, in which like numerals denote like parts throughout the several views, and in which:

FIG. 1 is a perspective, exploded view of a portable door lock constructed in accordance with this invention;

FIG. 2 is a perspective view of the portable door lock in assembled condition, showing its application to a door frame;

Figure 4:
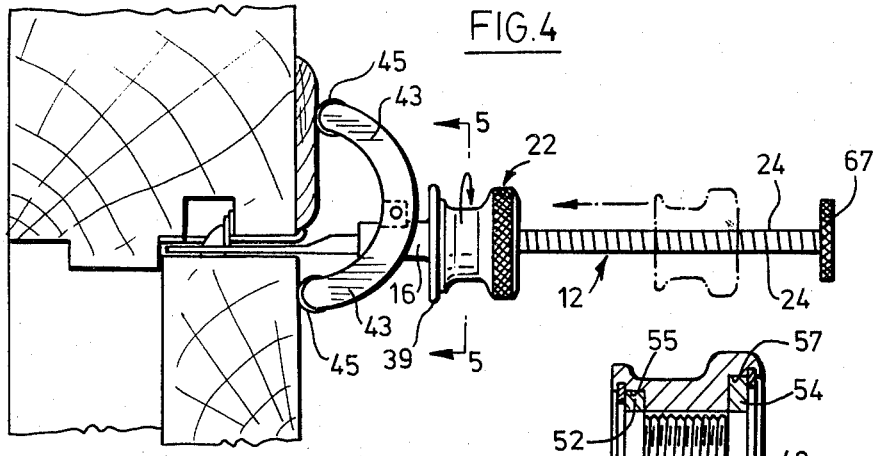
FIG. 4 is a view taken on a horizontal plane just above the portable door lock shown in FIG. 2.

Attention is first directed to FIGS. 1 and 2 of the drawings, which shows a portable door lock 10 consisting of a flat bar 12, adapted for insertion between a door 14 and a door frame 15, a slide block 16 having an internal opening 18 for receiving the flat bar 12 such that the slide block 16 is slidable along the flat bar 12, a brace member 20 pivotally mounted on the slide block 16, and means 21 adapted to prevent the slide block 16 from moving along the flat bar 12 in the direction away from the hook means.

The flat bar 12 has flat sides 24, and narrow upper and lower edges 26 and 27, respectively. At the leftward end in FIG. 1 (which we shall refer to as the forward end), the flat bar 12 defines two forwardly extending tines 28 integral with a vertically expanded portion 30, the latter also supporting a laterally extending flange 32 constituting hook means adapted to engage the frame.

Looking at FIG. 2, the flange 32 is adapted to enter the recess 33 in a standard striker plate 35, while the tines 28 are simply inserted into the slot between the frame and the closed door, thus maintaining the flat bar 12 in a vertical orientation, and also maintaining the general extent of the flat bar 12 in a horizontal direction, due to contact between the forward end of the lowermost of the tines 28 with the surface 37 of a door frame member 38 as seen in FIG. 2.

Turning now to FIG. 1, the slide block 16 is seen to include a circular flange 39 integral with a rectangular, forwardly directed portion 40 which surrounds the internal opening 18 for receiving the flat bar 12.

The rectangular portion 40 is integral at its further side in FIG. 1 with a vertically elongated pillar 41 having a central bore adapted to receive a pin 42, the top end of which can be seen in FIG. 1. The pin 42 extends upwardly and downwardly beyond the ends of the pillar 41 and engages suitable openings in two arcuate members 43 which are swingable in tandem about the pivot axis defined by the pin 42. As can be seen, the pivot axis defined by the pin 42 is parallel with the flat surfaces 24 of the flat bar 12. The location of the pin 42 is at an intermediate location on each arcuate member 43, and as can be seen in FIGS. 1 and 4, the arcuate members are concave as seen from the direction of the flange 32. Thus the extremities of the arcuate members extend generally forwardly toward the door and frame. The arcuate members 43 are spaced apart vertically (i.e. in the direction of their pivot axis), and two metal posts are provided, extending between each pair of ends of the arcuate members 43. The posts are not actually visible in FIG. 1, as they are enwrapped by soft plastic tubular members 45 which are mounted on the posts. As can be seen in FIG. 4, the tubular members 45 extend outwardly and forwardly from the extremities of the arcuate members 43, whereby only the tubular members 45 are allowed to contact the door and the frame. Since the tubular members are of soft plastic, and thus softer than the wood of the door or of the frame, no marking or scratching of these wooden surfaces is possible.

The means 21 shown in FIG. 1 and mentioned earlier, operates in conjunction with teeth 47 which are cut into the upper and lower edges 26 and 27 of the elongated flat bar 12. These teeth are, in effect, standard helical thread teeth, but of course are discontinuous due to the flatness of the bar 12. At 22 in FIG. 1 is shown a nut member in exploded relation, with all of the parts visible. The nut member, which is also seen in section in FIG. 3, has internal teeth 49 which match with, and therefore can engage, the teeth 47 on the upper and lower edges of the flat bar 12. Due to this construction, rotation of the nut member upon the flat bar 12, when the nut member is located against the circular flange 39 of the slide block 16, will urge the slide block 16 in the forward direction.

In order to avoid the necessity of having to screw the nut member all the way onto the elongated flat bar 12 from the rearward end, the teeth 49 of the nut member 22 are cut away at diametrically opposite locations 50 (see FIGS. 5 and 6), whereby when the flat bar is aligned with the cut away locations 50, the nut member 22 can slide with respect to the flat bar 12.

Figure 3:
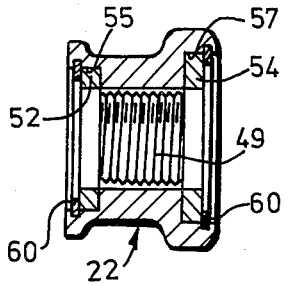
FIG. 3 is a vertical, axial sectional view of one component of the portable door lock of this invention.

As seen in FIGS. 1 and 3, the forward end of the nut member 22 is provided with a first disc 52, while the rearward end of the nut member 22 is provided with a second disc 54. Each disc is mounted in an appropriately sized circular recess 55 and 57, respectively, the recesses being concentric with the nut member axis. As seen in FIG. 1, each disc has a slot 62 adapted to snugly but slidably receive the flat bar 12, whereby the teeth of the nut member and those on the flat bar are always maintained in alignment. C-clips 60 are provided to maintain the discs 52 and 54 in position, the C-clips being receivable in appropriately positioned annular galleries in the nut member 22. The discs 52 and 54 being maintained rotatably within the nut member 22, it is possible to rotate the nut member 22 while the same is in engagement with the flat bar 12. The slots 62 in the discs 52 and 54 are long enough to allow the flat bar 12 to slide through them, when the flat bar 12 is aligned with the cut away locations 50.

Figure 5:
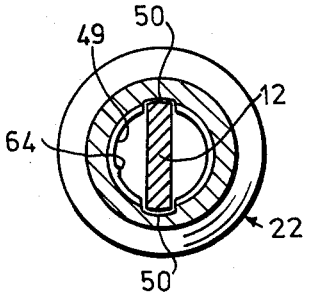
FIGS. 5 and 6 are sectional views taken at the line 5—5 in FIG. 4, showing the FIG. 3 component in two different positions of rotation.
Figure 6:
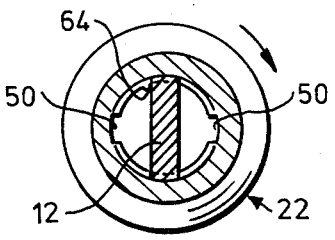

As can be seen in FIGS. 5 and 6, the teeth 49 of the nut member 22 are distorted at 64, the location 64 being spaced angularly away from the cut away locations 50, such that the rotation of the nut member 22 with respect to the flat bar 12 is limited. FIG. 5 shows the position of the nut member 22 when the flat bar 12 is aligned with the cut away locations 50, and FIG. 6 shows the maximum rotation from the FIG. 5 position which can be accomplished. As can be seen in FIG. 6, the distorted location 64 has been rotated up to and against the upper edge of the flat bar 12.

A stop member 67 (FIG. 1) is provided, and consists of a disc 68 with a knurled outer edge 69, and an integral threaded shaft portion 70. The threaded shaft portion 70 is adapted to be screwed into an internally threaded bore 72 in the rearward end of the flat bar 12.

In operation, with the door 14 open, the flat bar 12 is inserted in such a way that the flange 32 enters the recess 33, while the sliding block 16 and nut member 22 are withdrawn toward the rear of the flat bar 12. Such withdrawal permits the door 14 to be closed, whereupon the sliding block 16 is moved forwardly until the contact surfaces provided by the soft plastic tubular members 45 come into contact with the door and the door frame, respectively. This is shown in FIG. 4. In constructions in which no door frame is provided, the appropriate one of the tubular members 45 would simply rest against the adjacent wall surface.

Next, the nut member 22 is rotated until the locations 50 are in alignment with the flat bar 12, whereupon the nut member 22 can be slid forwardly to a position against the circular flange 39 sliding block 16. In FIG. 4, this is represented by movement of the nut member from the broken-line position to the solid line position. The nut member is then rotated as far as possible in the clockwise position (which would be about one quarter of a turn), thus causing it to move forwardly against the slide block 16 by a distance approximately equal to one quarter of the pitch length of the teeth 47. This will suffice to force the contact surfaces defined by the tubular members 45 snugly against the door and the door frame, thus securing the entire device firmly in position.

What is claimed is:

1. A portable door lock comprising:

an elongated flat bar for insertion between a door and a door frame, the flat bar having flat sides, narrow upper and lower edges, and hook means at one end for engaging the frame, a slide block having an internal opening for receiving said flat bar such that the slide block is slidable along the flat bar, a brace member pivotally mounted on the slide block and supporting two spaced contact surfaces projecting in the direction of the hook means, whereby one surface can rest against the door and the other against either the frame or the wall adjacent the frame, the contact surfaces being formed by resilient plastic tubes mounted on metal posts, and releasable means for preventing the slide block from moving along the flat bar in the direction away from the hook means.

2. A portable door lock as claimed in claim 1, in which the brace member includes two arcuate members swingable in tandem about a pivot axis parallel with the flat surface of the flat bar, the axis being at an intermediate point on the arcuate members and the members being concave as seen from the hook means, the members being spaced apart in the direction of the pivot axis and one of each said metal posts extending between each pair of ends of the arcuate members.

3. A portable door lock as claimed in claim 1, in which said releasable means includes teeth on the upper and lower edges of the flat bar, and a nut member having internal teeth matching said teeth on the upper and lower edges of the flat bar, whereby rotation of the nut member when located against said slide block can urge the latter toward the hook means.

4. A portable door lock as claimed in claim 3, in which the internal teeth of the nut member are cut away at diametrically opposite locations, whereby when the flat bar is aligned with said cut away locations, the nut member can slide with respect to the flat bar.

5. A portable door lock as claimed in claim 4, in which each end of the nut member is provided with a disc rotatably mounted in a circular recess concentric with the nut member axis, each disc having a slot adapted to snugly but slidably receive the flat bar, whereby the teeth of the nut member and those on the flat bar are maintained in alignment.

6. A portable door lock as claimed in claim 3, further including a stop member removably secured to the end of the flat bar remote from the hook means, having the function of preventing disengagement of the nut member from the flat bar.

7. A portable door lock as claimed in claim 6, in which the said teeth in the nut member are distorted at a location spaced angularly from said cut away locations, whereby to limit the rotation of the nut member with respect to the flat bar.

* * * * *